US005658715A

United States Patent [19]

Nakamura et al.

[11] Patent Number: 5,658,715

[45] Date of Patent: Aug. 19, 1997

[54] METHOD FOR PROCESSING SILVER HALIDE COLOR REVERSAL PHOTOGRAPHIC LIGHT-SENSITIVE MATERIAL

[75] Inventors: Takashi Nakamura; Yasuhisa Ogawa, both of Minami-ashigara, Japan

[73] Assignee: Fuji Photo Film Co., Ltd., Kanagawa, Japan

[21] Appl. No.: 623,164

[22] Filed: Mar. 28, 1996

[30] Foreign Application Priority Data

Mar. 28, 1995 [JP] Japan ..... 7-069068

[51] Int. Cl.[6] ..... G03C 5/50

[52] U.S. Cl. ..... 430/379; 430/399; 430/407; 430/409; 430/410; 430/486; 430/487; 430/488

[58] Field of Search ..... 430/379, 407, 430/409, 410, 486, 487, 488, 399

[56] References Cited

U.S. PATENT DOCUMENTS 5,024,925 6/1991 Deguchi ..... 430/379
5,213,942 5/1993 Deguchi et al. ..... 430/379
5,238,794 8/1993 Hirose et al. ..... 430/379
5,272,049 12/1993 Sakanoue et al. ..... 430/379
5,372,918 12/1994 Usui et al. ..... 430/379

FOREIGN PATENT DOCUMENTS 59-180558 10/1984 Japan .
62-234161 10/1987 Japan .
62-234162 10/1987 Japan .
62-242938 10/1987 Japan .

*Primary Examiner*—Hoa Van Le
*Attorney, Agent, or Firm*—Birch, Stewart, Kolasch & Birch, LLP

[57] ABSTRACT

A silver halide color reversal photographic light-sensitive material processing method which forms a color reversal image by performing first black-and-white development, fogging process, color reversal development, and desilvering process by using a color reversal developer with a composition containing a non-dye-forming competing coupler, a silver halide fogging agent, and a carboxybenzenesulfonic acid compound and not containing hydroxylamine or its derivative.

6 Claims, 2 Drawing Sheets

METHOD FOR PROCESSING SILVER HALIDE COLOR REVERSAL PHOTOGRAPHIC LIGHT-SENSITIVE MATERIAL

BACKGROUND OF THE INVENTION

1. Field of the Invention

The present invention relates to a method for processing a silver halide color reversal photographic light-sensitive material and, more particularly, to improvements in the composition of a color reversal developer and a low-replenishment processing method using the developer.

2. Description of the Related Art

Generally, the basic steps of processing of a silver halide color photographic light-sensitive material are a color development step and a desilvering step. In the color development step, a silver halide exposed by a color developing agent is reduced to produce silver, and the oxidized color developing agent reacts with a coloring agent (coupler) to form a dye image. Common silver halide color photographic light-sensitive materials are subjected to the color development step after being imagewise-exposed. However, silver halide color reversal photographic light-sensitive materials after being imagewise-exposed are subjected to the color development step after black-and-white development and reversal steps. In the subsequent desilvering step, the silver produced in the color development step is oxidized by an action of an oxidizer, a so-called bleaching agent. The oxidized silver is then dissolved by an agent, a so-called fixing agent, which forms complex ion of silver ion. Through this desilvering step, only a dye image is formed in the color light-sensitive material. Thus the desilvering step generally consists of the bleaching step and the fixing step. In the case of a bleach-fixing step in which the bleaching and fixing steps are done in a single bath, the bleach-fixing step is performed after the bleaching step or between the bleaching step and the fixing step.

The resultant light-sensitive material in which the dye image is formed is processed with a stabilizer after the desilvering process for the storage properties of the obtained dye image. The processing using the stabilizer is performed after a washing step or immediately after the desilvering. In the processing of color reversal light-sensitive materials, there is a known method which stabilizes a dye image by adding an image stabilizing agent to a control solution, instead of using the stabilizer in the final bath.

It is determined that disposal of waste solutions of photographic processing in the sea will be inhibited from 1996. Accordingly, reducing the waste solutions of photographic processing is being eagerly desired. In particular, compared to a black-and-white developer the processing steps of color development are complicated, so the waste solutions of photographic processing are concentrically treated in the color development, and the amount of the waste solutions also is large in the processing. Therefore, reducing the waste solutions of the color photographic processing is being earnestly desired. Of the color processing, the processing steps of color paper or color negative film processing are relatively simple, and the number of baths is small and the processing function is simple in color reversal paper processing. Accordingly, techniques of low replenishment have been developed and low-replenishment formulations have been sequentially proposed for these processes. Consequently, a total waste processing solution per processing of 1 $m^2$ of a light-sensitive material is recently reduced to 100 ml for color paper, 900 ml for color reversal paper, and nearly 3000 ml for color negative films.

On the other hand, approximately 9 $l/m^2$ are still replenished in development of color reversal films in which the processing steps are complicated and the number of processing baths is large. This amount of waste solutions is three times, ten times, and ninety times as large as those for color negative films, color reversal paper, and color paper, respectively. Accordingly, it is of urgent necessity to decrease the number of processing steps or reduce the replenishment of each processing solution in the development of color reversal films.

Additionally, the development of color reversal films involves a special color development step in which 70 to 90% of silver coated on a light-sensitive material are averagely developed in the first development and almost all the residual silver is developed by chemically fogging the remaining 10 to 30% of the silver halide, thereby performing color development.

This color development (called color reversal development), therefore, is required to have an entirely different function from that of the conventional color development, and is development entirely different from simple black-and-white development.

That is, this color developer (color reversal developer) contains a non-dye-forming competing coupler to control the photographic gradation. That is, the oxidized form of a developing agent, which forms when the developing agent reduces a silver halide, reacts with a coupler in a light-sensitive material, and this reaction is partially taken by a non-dye-forming coupler by competition. This adjusts the gradation of color photographs. This color developer also contains a fogging agent for silver halide emulsions of thioethers. The color reversal development having this complicated mechanism has not been changed to date in both the formulation and the quantity of replenisher since it was introduced into the market in 1976.

This complicated color reversal developer is made from a phosphoric acid buffer solution because of its special effect. In Japan, especially in the closed seas and lakes (e.g., the Inland Sea of Japan, the Kasumigaura, and the Lake of Biwa), the regulations on phosphorus have been made more rigorous from the point of view of nourishment. When an activation sludge treatment is performed for the waste solutions of photographic processing, phosphorus is not completely treated and flows into these closed seas or lakes.

Furthermore, in silver halide photographic light-sensitive materials (to be referred to as light-sensitive materials hereinafter), it is almost not possible to input or output various information during photographing or printing; i.e., only the date of photographing can be optically input/output. However, as recently disclosed in JP-A-4-68336 ("JP-A" means Published Unexamined Japanese Patent Application), JP-A-4-73737, or JP-A-5-88283, by forming a transparent magnetic recording layer on the entire surface of a light-sensitive material it has become possible to input, on light-sensitive materials, the date of photographing, the conditions of photographing such as weather and a reduction/extension ratio, the number of extra prints, a portion to be zoomed, a message, and the conditions of development and printing. Also, it has become possible to input various information to image apparatuses such as television/video recorders. Therefore, a demand has arisen for a promising method.

Beautiful images can be obtained by dipping light-sensitive materials into various processing solutions. However, since the labor cost is presently high it is preferable to automatically perform these processing steps, and an automatic processor is in many instances used in these steps. For this purpose, a jigenki free from a magnetic reading loss is required.

Unfortunately, the magnetic characteristics of light-sensitive materials having a magnetic recording layer deteriorate when these materials are processed with high-pH color developers.

SUMMARY OF THE INVENTION

It is, therefore, the first object of the present invention to reduce replenishment of a color reversal developer having the complicated function as described above and provide a means for removing a phosphate.

It is the second object of the present invention to provide a processing method which causes little magnetic deterioration in a novel photographic system using a color reversal film having a magnetic recording layer.

The above objects of the present invention are achieved by making a color reversal developer contain a compound represented by Formula (1) below and contain neither hydroxylamine nor its derivative. As a result, it is found that, for example, phosphorus can be removed and deterioration in the magnetic characteristics is little even in processing of a novel color reversal film having a magnetic recording layer.

That is, the above objects of the present invention are achieved by use of the means described in items (1) to (5) below.

(1) A method for processing a silver halide color reversal photographic light-sensitive material, in which a silver halide color reversal photographic light-sensitive material having at least one negative silver halide emulsion layer on a support is imagewise-exposed and subjected to first black-and-white development, fogging process, color reversal development, and desilvering process, thereby forming a color reversal image, wherein the color reversal development is performed by using a color reversal developer with a composition containing (a) a non-dye-forming competing coupler, (b) a silver halide fogging agent, and (c) a compound represented by Formula (1) below, and not containing (d) hydroxylamine or a derivative thereof:

Formula (1)

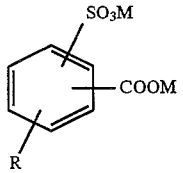

wherein R represents —OH, —$NO_2$, X, H, —COOH, —$SO_3M$, a lower alkyl group having 1 to 4 carbon atoms, or a hydroxy group- or carboxyl group-substituted lower alkyl group having 1 to 4 carbon atoms, M represents Li, Na, or K, and X represents halogen.

(2) The method described in item (1) above, wherein hydrazinic acid and 3,6-dithiaoctane-1,8-diol are used as the non-dye-forming competing coupler and the silver halide fogging agent, respectively.

(3) The method described in item (1) or (2) above, wherein the processing is continuously performed while the color reversal developer is replenished at a quantity of replenisher of not more than 1100 ml/$m^2$ or less, preferably 40 ml/$m^2$ to 1100 ml/$m^2$.

(4) The method described in any one of items (1) to (3) above, wherein the processing is performed while halogen is removed from the color reversal developer and the color reversal developer is replenished at a quantity of replenisher of 40 to 500 ml/$m^2$.

(5) The method described in any one of items (1) to (4) above, wherein the support of the light-sensitive material is made from annealed polyethylenenaphthalate and 85 to 105 μm in thickness, and has a magnetic recording layer made from a ferromagnetic fine powder on a side away from the emulsion layer.

DETAILED DESCRIPTION OF THE PREFERRED EMBODIMENTS

Figure 1:
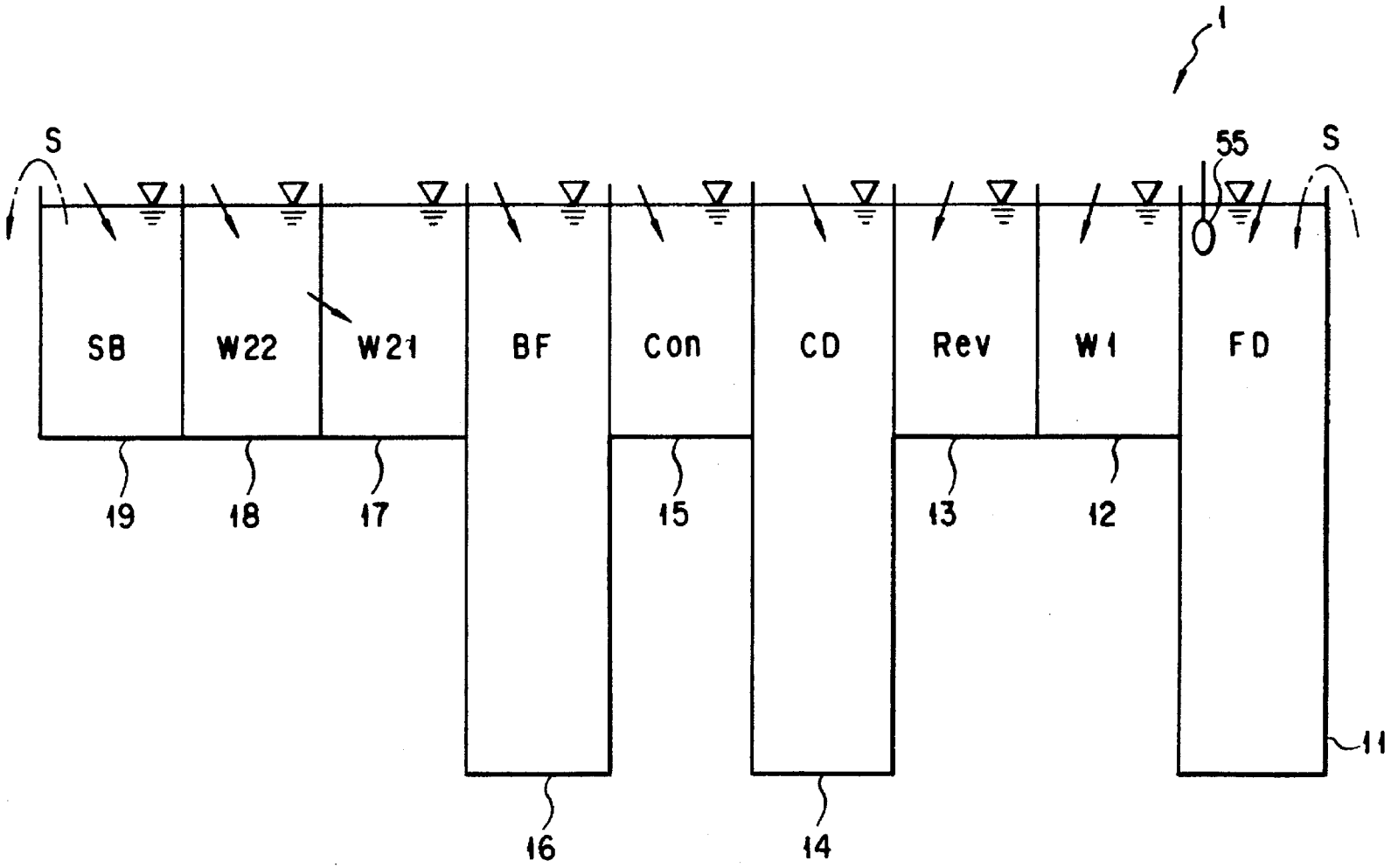
FIG. 1 is a schematic view showing the arrangement of tanks of a processor used in the method of the present invention, in which a halogen removing means in FIG. 2, is not provided in a portion CD.

Some developers containing a compound represented by Formula (1) above are known to those skilled in the art as will be described below.

(a) JP-A-59-180558 shows that addition (0.1 to 10 g/l) of a salicylic acid derivative containing a compound represented by Formula (1) to a color developer increases the stability of the color developer at a high pH (pH 9 to 12, preferably pH 9 to 11), and that the solution stability was excellent especially when iron was contained.

Also, (b) JP-A-60-93433 describes that addition of 0.1 mol/l or more of a compound (acid dissociation constant= $1\times10^{-11}$ to $3\times10^{-13}$) containing a compound represented by Formula (1) makes it possible to form a black-and-white developer with pH=10.5 to 12.3 and stabilizes the final halftone quality of the black-and-white developer.

Thereafter, getting a hint from the inventions described in items (a) and (b) above, in (c) JP-A-62-234161 a technique is developed in which no stains are produced when a salicylic acid derivative is added to a color developer during stabilization of color paper. Also, (d) JP-A-62-234162 demonstrates that a solution which has a pH stable at high pH values and forms no deposit can be formed by adding 12 g/l or more of a salicylic acid derivative to a color developer containing hydroxylamine, and that a change in the photographic properties of the solution after aging is small.

Furthermore, getting a hint from the inventions described in items (a) and (b) above, a technique described in (e) JP-A-62-242938 is developed. This publication describes a method of processing using a color developer of pH≧10 which contains both a hydroxylamine derivative and $R_1.SO_3X$ (containing a part of a compound represented by Formula (1)). This publication also describes that no tar is produced even when rapid development is performed by raising the pH of the color developer.

Any of these techniques disclosed in items (a), (c), (d), and (e) above associated with color development focuses attention on color paper processing and does not imply the use in complicated color reversal development of color reversal. The black-and-white developer disclosed in item (b) above improves the stability of the halftone quality in black-and-white development in the presence of hydrazine. Therefore, even the researchers in this field of art do not readily think of diverting this technique to color reversal development.

In the present invention, "not containing hydroxylamine or its derivative" means that neither hydroxylamine nor its derivative represented by Formula (2) below is contained.

$R_1R_2N—OH$ Formula (2)

wherein $R_1$, $R_2$ represents H, an alkyl group having 1 to 4 carbon atoms, a hydroxy group-, sulfo group- or carboxyl group-substituted alkyl group having 1 to 3 carbon atoms, or an alkoxy group having 1 to 3 carbon atoms. $R_1$ and $R_2$ may be bonded to each other to form a ring.

When a compound represented by Formula (2) is contained in the color reversal developer used in the present invention, the role of a non-dye-forming competing coupler such as citrazinic acid is changed, so no desired photographic properties can be obtained. One reason is considered that because the pH used is high a compound represented by Formula (2) gives rise to black-and-white development of a silver halide. Furthermore, citrazinic acid reacts with the oxide of a color developing agent, which forms upon color development, and a coupler in the light-sensitive material, the color developing agent, and the oxide react with each other to suppress the formed color image, thereby adjusting the gradation. Unfortunately, it is considered that a compound represented by Formula (2) black-and-white-develops the residual silver halide earlier than the color developing agent and makes color development essentially hardly occur, and consequently unwanted gradation and photographic properties result. Accordingly, it is an essential condition that a compound represented by Formula (2) be not contained in the color reversal developer.

Light-sensitive materials preferably used in the present invention and development of color reversal films will be described below.

An imagewise-exposed silver halide color photographic light-sensitive material of the present invention is desilvered after color development. This desilvering process can be performed immediately after the color development without performing any other processing. Alternatively, to prevent unnecessary post-development and air fogging and thereby reduce carry-over of the color developer to the desilvering step, or to wash out and make harmless the constituents such as the sensitizing dye or dyestuff contained in the photographic light-sensitive material and the color developing agent with which the photographic light-sensitive material is impregnated, the desilvering process can be done after processing steps such as stopping, control, and washing are performed after the color development.

In the desilvering process, after bleaching is performed using a processing solution having a bleaching power, fixation is performed using a processing solution having a fixing power. The bleaching and fixing processes can be performed individually in this manner or simultaneously by using a bleach-fixing solution having both the bleaching and fixing powers (bleach-fixing process). Each of these bleaching, fixing, and bleach-fixing processes can be done in a single bath or two or more baths.

In the present invention, the processing solution with a bleaching power means processing solutions containing a bleaching agent of the processing solutions used in the desilvering step. More specifically, a bleaching solution and the bleach-fixing solution are the processing solution with a bleaching power. Also, the processing solution with a fixing power means processing solutions containing a fixing agent of the processing solutions used in the desilvering step. More specifically, a fixing solution and the bleach-fixing solution are the processing solution with a fixing power.

In the present invention, it is preferable that the processing solution with a bleaching power be the bleaching solution and the processing solution with a fixing power be the fixing solution.

The color reversal developer of the present invention contains aromatic primary amine color developing agents. The use amount of these color developing agents is preferably 1 g to 20 g, and more preferably 2 g to 8 g per liter of the color developer.

These color developing agents can be used singly or in the form of a combination of two or more types of them. Specific compounds will be described below, but the color developing agents are not limited to these compounds.

D-1 N,N-diethyl-p-phenylenediamine
D-2 2-amino-5-diethylaminotoluene
D-3 2-amino-5-(N-ethyl-N-laurylamino)toluene
D-4 4-(N-ethyl-N-(β-hydroxyethyl)amino)aniline
D-5 2-methyl-4-(N-ethyl-N-(β-hydroxyethyl)amino)aniline
D-6 4-amino-3-methyl-N-ethyl-N-(β-(methanesulfonamido)ethyl)-aniline
D-7 N-(2-amino-5-diethylaminophenylethyl)-methanesulfonamide
D-8 N,N-dimethyl-p-phenylenediamine
D-9 4-amino-3-methyl-N-ethyl-N-methoxyethylaniline
D-10 4-amino-3-methyl-N-ethyl-N-β-ethoxyethylaniline
D-11 4-amino-3-methyl-N-ethyl-N-β-butoxyethylaniline Preferable color developing agents used in the present invention are D-4, D-5, and D-6.

The color reversal developer used in the present invention can be added with, where necessary, as preservatives, sulfite such as sodium sulfite, potassium sulfite, sodium bisulfite, potassium bisulfite, sodium metasulfite, and potassium metasulfite, and a carbonyl compound sulfite adduct. The addition amount of the preservative is preferably 20 g or less, more preferably 10 g or less, and most preferably 0.05 to 5 g per liter of the color developer.

In the present invention, non-dye-forming competing couplers presented below need to be contained to adjust the gradation of a color reversal image. Non-dye-forming competing couplers are described in U.S. Pat. Nos. 2,742,832, 3,520,690, and 3,645,737, and JP-B-44-9504 ("JP-B" means Published Examined Japanese Patent Application), JP-B-44-9506, and JP-B-44-9507. Examples of compounds most preferably used are citrazinic acid, J-acid, H-acid, and resorcin. Of these compounds, citrazinic acid is particularly favorable.

In the present invention, it is unpreferable to use hydroxylamine or hydroxylamines described in JP-A-2-64632 as preservatives.

This is because hydroxylamine is unsuitable to the color reversal developer and hence no desirable photographic properties (gradation) can be attained as described above. Other examples of an effective developer preservative are sulfinic acids, a-hydroxyketones and α-aminoketones described in JP-A-63-44656, and/or various sugars described in JP-B-63-36244. Also, in combination with these compounds, it is possible to use monoamines described in JP-A-63-4235, JP-A-63-24254, JP-A-63-21647, JP-A-63-146040, JP-A-63-27841, and JP-A-63-25654, diamines described in JP-A-63-30845, JP-A-63-146040, and JP-A-63-43439, polyamines described in JP-A-63-21647 and JP-A-63-26655, polyamines described in JP-A-63-44655, nitroxy radicals described in JP-A-63-53551, alcohols described in JP-A-63-43140 and JP-A-63-53549, oximes described in JP-A-63-56654, and tertiary amines described in JP-A-63-239447.

As other preservatives, it is possible to add, if necessary, various metals described in JP-A-57-44148 and JP-A-57-53749, salicylic acids described in JP-A-59-180588, alkanolamines described in JP-A-54-3532, polyethyleneimines described in JP-A-56-94349, and aromatic polyhydroxy compounds described in U.S. Pat. No. 3,746,544.

The pH of the color reversal developer used in the present invention is preferably 11 to 13.5, and more preferably 11.7 to 13. This color reversal developer can contain compounds consisting of other known developer components.

To keep the above pH at least the use of a compound represented by Formula (1) is necessary.

Specific examples of a compound represented by Formula (1) are (1) 3-carboxy.benzenesulfonic acid, (2) 3-hydroxy-4-carboxy-benzenesulfonic acid, (3) 3,4-carboxy.benzenesulfonic acid, (4) 3-chloro-4-carboxy-benzenesulfonic acid, (5) 4-methyl-3-carboxybenzenesulfonic acid, (6) 4-hydroxymethyl-3-carboxybenzenesulfonic acid, (7) 4-carboxymethyl-3-carboxybenzenesulfonic acid, (8) 4-nitro-3-carboxybenzenesulfonic acid, (9) 4-hydroxy-3-carboxybenzenesulfonic acid (sulfosalicylic acid), and

(10) 3-carboxy-4-hydroxy-5-sulfonic acid.benzenesulfonic acid.

A compound represented by Formula (1) can also be Li-, Na-, and K-substituted compounds of the compounds described above. The addition amount of these compounds is 0.04 to 0.4 mol/l, preferably 0.05 to 0.2 mol/l.

Phosphate and borate can be used in combination with these compounds. Examples are trisodium phosphate, dipotassium phosphate, potassium borate, and sodium tetraborate. Although these compounds are particularly effective in a dissolving ambient with high pH=11.7 to 13, the amount is preferably as small as possible from the viewpoint of environmental protection. Additionally, KOH and NaOH are used as alkali agents.

The addition amount of phosphoric acid and boric acid to the color developer is preferably 0.01 mol/l or more, and most preferably 0.01 mol/l to 0.1 mol/l.

Various chelating agents can also be added to the color reversal developer as suspension stabilizers for calcium or magnesium or to improve the stability of the color developer. Organic acid compounds are preferable as the chelating agents, and examples are aminopolycarboxylic acids, organic phosphonic acids, and phosphonocarboxylic acids. Specific examples are nitrilotriacetic acid, diethylenetriaminepentaacetic acid, ethylenediaminetetraacetic acid, N,N-N-trimethylenesulfonic acid, ethylenediamine-N,N,N',N'-tetramethylenephosphonic acid, transcyclohexanediaminetetraacetic acid, 1,2-diaminopropanetetraacetic acid, hydroxyethyliminodiacetic acid, glycoletherdiaminetetraacetic acid, ethylenediamineorthohydroxyphenylacetic acid, 1-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxyoxybenzene-3,5-disulfonic acid. Two or more types of these chelating agents can be used together in case of necessary.

The addition amount of the chelating agents is preferably 0.01 g to 20 g, and most preferably 0.1 g to 10 g per liter of the color reversal developer.

Given development accelerators can be added to the color reversal developer as needed. In particular, it is essential to add thioether-based fogging accelerators in order to fully utilize the effect of a reversal fogging bath as a pre-bath. Since these fogging agents are most accelerated at pH=11.7 to 13, it is preferable to use them within this pH range.

As the thioether-based fogging agents, thioether-based compounds described in, e.g., JP-B-37-16088, JP-B-37-5987, JP-B-38-7826, JP-B-44-12380, and JP-B-45-9019, and U.S. Pat. 3,813,247 are used. In addition, an amine compound such as ethylenediamine is usable.

Of these compounds, thioether-based compounds are preferable, and among them 3,6-dithiaoctane-1,8-diol is preferred.

It is preferable to make the color reversal developer contain at least 5 to 40 mmols of a color developing agent; 1 to 10 mmols of a non-dye-forming competing coupler; 1 to 20 mmols of a fogging agent; and 10 to 200 mmols of a compound represented by Formula (1).

Processing can be perform&d when the quantity of replenisher of the color reversal developer in the present invention is 40 to 4000 ml/m$^2$. However, the quantity of replenisher is preferably as low as possible because decreasing the quantity of replenisher can reduce the waste solution. When sulfosalicylic acid is used, processing is possible at 1100 ml/m$^2$ or less. Additionally, if electrolytic dialysis also is performed, it is possible to prevent air oxidation and remove halogen. The result is that the quantity of replenisher can be decreased to 400 ml/m$^2$. Accordingly, the quantity of replenisher is preferably 40 to 1100 ml/m$^2$, and more preferably 400 to 1100 ml/m$^2$. Since the quantity of replenisher is 40 ml/m$^2$ when a squeegee is good, i.e., when the solution carry-over is at minimum, a quantity of replenisher lower than this value is impossible. If the quantity of replenisher is higher than 1100 ml/m$^2$, development fogging tends to occur.

In the present invention, when polyethylenenaphthalate is used as a support the thickness of the support is preferably 85 to 105 μm. This is so because if the thickness of the polyethylenenaphthalate support exceeds 105 μm, the support cannot well pass through rollers of an automatic processor, resulting in an abrupt increase in the conveyance fraction defective. In contrast, a thickness of less than 85 μm is too small, so the support cannot well pass through a processor either to thereby cause an abrupt increase in the conveyance fraction defective. Accordingly, when polyethylenenaphthalate is used a thickness of 85 to 105 μm is optimum.

When the color reversal photographic light-sensitive material is processed in the present invention, black-and-white development is performed prior to color development.

As a black-and-white developer for use in the present invention, it is possible to use developing agents known to those skilled in the art. Examples of the developing agent are dihydroxybenzenes (e.g., hydroquinone and hydroquinonemonosulfonic acid), 3-pyrazolidones (e.g., 1-phenyl-3-pyrazolidone and 1-phenyl-4-methyl-4-hydroxymethyl-3-pyrazolidone), aminophenols (e.g., N-methyl-p-aminophenol), ascorbic acid (e.g., L-ascorbic acid), and a heterocyclic compound described in U.S. Pat. No. 4,067,872 in which a 1,2,3,4-tetrahydroquinoline ring and an indolene ring are condensed. These developing agents can be used singly or together.

Of these developing agents, hydroquinonemonosulfonic acid or the combination of salt of hydroquinonemonosulfonic acid and 1-phenyl-4-methyl-4-hydroxymethyl-3-pyrazolidone is preferable. Alternatively, the use of ascorbic acid in place of hydroquinonemonosulfonic or its salt is preferable. These developing agents are commonly used within the range of 0.001 to 1.0 mol, preferably 0.005 to 0.8 mol per liter of the developer. When developing agents of 3-pyrazolidones also are used, these developing agents are used within the range of 0.001 to 0.1 mol, preferably 0.005 to 0.05 mol per liter of the developer. The ratio of the latter is 1 to 50, preferably 5 to 30 with respect to 100 of the former.

The black-and-white developer for use in the present invention can contain, if necessary, a preservative (e.g., sulfite or bisulfite), a buffering agent (e.g., carbonate, boric acid, borate, or alkanolamine), an alkaline agent (e.g., hydroxide or carbonate), a soluble tablet (e.g., polyethyleneglycols or their esters), a pH control agent (e.g., an organic acid such as acetic acid), a sensitizer (e.g., quaternary ammonium salt), a development accelerator, a surfactant, an anti-foaming agent, a film hardener, and a viscosity imparting agent.

It is necessary to add a compound acting as a silver halide solvent to the black-and-white developer used in the present invention. In general, however, sulfite to be added as the preservative described above plays this role. Examples of sulfite and other usable silver halide solvents are KSCN, NaSCN, $K_2SO_3$, $Na_2SO_3$, $K_2S_2O_5$, $Na_2S_2O_5$, $K_2S_2O_3$, and $Na_2S_2O_3$.

The pH of the developer thus prepared ranges between preferably 8.5 and 11.5, and most preferably 9.5 and 10.0. In the case of a hydroquinone-based developing agent, it is preferable that the replenisher solution fall within the range of −0.1 to +0.1 of the target pH value. When ascorbic acid is used as the developing agent, the replenisher solution is preferably set to be higher by 0.3 to 0.6 than the target pH value.

The quantity of replenisher of the black-and-white developer is preferably 3 l or less, and most preferably 2.5 l to 700 ml per $m^2$ in the case of a color reversal film. In the case of color reversal paper, the quantity of replenisher is preferably 500 ml to 50 ml, and most preferably 250 ml to 100 ml per $m^2$.

To reduce the quantity of replenisher, it is favorable to prevent evaporation and air oxidation of the solutions by decreasing the contact areas of the processing tank and the replenisher tank with air.

The contact areas Of the photographic processing solutions with air in the processing tank and the replenisher tank can be represented by an aperture defined below:

aperture=(contact area ($cm^2$) of processing solution with air)/(volume ($cm^3$) of processing solution)

This aperture is preferably 0.1 or less, and more preferably 0.001 to 0.05. In order to reduce the aperture, shielding members such as floating covers can be provided on the surfaces of the photographic processing solutions in the processing tank and the replenisher tank. It is also possible to use a method of using a movable cover described in JP-A-1-82033 and a slit developing method descried in JP-A-63-216050. Reducing the aperture is preferably applied to all processing steps, i.e., not only to the color and black-and-white development steps but also to the individual subsequent steps, e.g., bleaching, bleach-fixing, fixing, washing, and stabilizing steps. In addition, the quantity of replenisher can also be reduced by using a means for suppressing storage of bromide ions in the developer.

A reversal bath used after the black-and-white development can contain known fogging agents. Examples of the fogging agents are stannous ion complex salts, such as stannous ion-organic phosphoric acid complex salt (U.S. Pat. No. 3,617,282), stannous ion organic phosphonocarboxylic acid complex salt JP-B-56-32616), and stannous ion-aminopolycarboxylic acid complex salt (U.S. Pat. No. 1,209,050), and boron compounds, such as a boron hydride compound (U.S. Pat. No. 2,984,567) and a heterocyclic amineborane compound (British Patent 1,011,000). The pH of this fogging bath (reversal bath) covers a wide range from acidic to alkaline sides. The pH is 2 to 12, preferably 2.5 to 10, and most preferably 3 to 9. Light-reversal processing using re-exposure can be performed instead of the reversal bath. Also, the reversal step itself can be omitted by adding the above fogging agents to the color developer.

Examples of the bleaching agent for use in the processing solution with a bleaching power in the present invention are a compound of a multivalent metal such as iron(III), peroxides, quinones, and a nitro compound. Typical examples of the bleaching agent are bleaching agents of organic complex salts of iron(III), e.g., ethylenediaminetetraacetic acid, diethylenetriaminepentaacetic acid, cyclohexanediaminetetraacetic acid, methyliminodiacetic acid, glycoletherdiaminetetraacetic acid, and 1,3-propylenediaminetetraacetic acid iron complex salt described in JP-A-4-121739, page 4, the lower right column to page 5, the upper left column, carbamoyl-based bleaching agents described in JP-A-4-73647, bleaching agents with a heterocyclic ring described in JP-A-4-174432, bleaching agents such as N-(2-carboxyphenyl)iminodiacetic acid secondary iron complex salt described in European Patent 520457, bleaching agents such as ethylenediamine-N-2-carboxyphenyl-N,N',N'-triacetic acid secondary iron acetic acid described in European Patent 530828A1, bleaching agents described in European Patent 501479, bleaching agents described in JP-A-4-127145, and aminopolycarboxylic acid secondary iron salt or its salt described in JP-A-5-303186 and JP-A-3-144446, page (11).

Organic aminocarboxylic acid iron(III) complex salts are particularly useful in both the bleaching solution and the bleach-fixing solution. The pH of the bleaching or bleach-fixing solution using these aminopolycarboxylic acid iron (III) complex salts is normally 4.0 to 8. In order to increase the processing speed, however, processing can be performed at a lower pH.

In the processing bath with a bleaching power in the present invention, a rehalogenating agent described in JP-A-3-144446, page (12), a pH buffering agent, and known additives, aminopolycarboxylic acids, and organic phosphonic acids can be used in addition to the bleaching agent.

Also, various bleaching accelerators can be added to the bleaching solution or its pre-bath. Examples of the bleaching accelerators are compounds having a mercapto group or a disulfide group, described in U.S. Pat. No. 3,893,858, West German Patent 1,290,812, British Patent 1,138,842, JP-A-53-95630, and Research Disclosure No. 17129 (July, 1978), a thiazolidine derivative described in JP-A-50-140129, a thiourea derivative described in U.S. Pat. No. 3,706,561, iodide described in JP-A-58-16235, polyethyleneoxides described in German Patent 2,748,430, and a polyamine compound described in JP-B-45-8836. Compounds described in U.S. Pat. No. 4,552,834 are also preferable. These bleaching accelerators can also be added to light-sensitive materials. These bleaching accelerators are particularly effective when color light-sensitive materials for photography are bleach-fixed. The mercapto compounds described in British Patent 1,138,842 and JP-A-2-190856 are preferable.

The processing solutions (the bleaching solution and the bleach-fixing solution) having a bleaching power preferably contains an organic acid, in addition to the above compounds, in order to prevent bleaching stains. A most preferable organic acid is a compound whose acid dissociation constant (pKa) is 2 to 5. Specific preferable examples of the compound are acetic acid, lactic acid, malonic acid, glutaric acid, succinic acid, propionic acid, and hydroxyacetic acid.

It is preferable that these organic acids be contained in an amount of 0.005 to 3 mols per liter of the processing solution with a bleaching power.

Although the bleaching process is preferably performed immediately after the color development, in the case of reversal process the bleaching process is generally done via, e.g., a control bath (which can also be a bleaching accelerator bath).

In the control solution, it is possible to add various bleaching accelerators to be described later, e.g., aminopolycarboxylic acid chelating agents such as ethylenediaminetetraacetic acid, diethylenetriaminepentaacetic acid, 1,3-diaminopropanetetraacetic acid, and cyclohexanediaminetetraacetic acid; sulfites such as sodium sulfite and ammonium sulfite, and thioglycerine, aminoethanethiol, and sulfoethanethiol. Also, to prevent scum, it is preferable to add sorbitane esters of fatty acid substituted by ethyleneoxide, described in U.S. Pat. No. 4,839,262, and polyoxyethylene compounds described in U.S. Pat. No. 4,059,446 and Research Disclosure Vol. 191, 19104 (1980). These compounds can be used in an amount of 0.1 g to 20 g, preferably 1 g to 5 g per liter of the control solution.

Image stabilizers to be described below also can be contained in the control bath.

The pH of the control bath commonly ranges between 3 and 11, preferably 4 and 9, and more preferably 4.5 and 7. The processing time in the control bath is preferably 20 sec to 5 min, more preferably 20 sec to 100 sec, and most preferably 20 sec to 60 sec. The quantity of replenisher in the control bath is preferably 30 ml to 3000 ml, and most preferably 50 ml to 1500 ml. The processing temperature in the control bath is preferably 20° C. to 50° C., and most preferably 30° C. to 40° C.

In the present invention, after the desilvering process is performed, processing can be performed in a stabilization bath after washing or can be immediately performed using a stabilizer without performing washing. An amount of water used in the washing step can be set over a broad range in accordance with the properties (e.g., a property determined by use of a coupler) of the light-sensitive material, the intended use of the material, the temperature of the water, the number of water tanks (the number of stages), a replenishing scheme such as a counter or forward current, and other conditions. The relationship between the amount of water and the number of water tanks in a multi-stage counter-current scheme can be obtained by a method described in "Journal of the Society of Motion Picture and Television Engineering", Vol. 64, P. 248–253 (May, 1955). According to the above-described multi-stage counter-current scheme, the amount of water for washing can be greatly decreased. Since washing water stays in the tanks for a long period of time, however, bacteria multiply and floating substances may be undesirably attached to the light-sensitive material. In order to solve this problem in the processing of the present invention, a method of decreasing calcium and magnesium ions can be effectively utilized, as described in JP-A-62-288838. Also, it is preferable to use a germicide such as an isothiazolone compound and cyabendazoles described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986).

As the stabilizer of the present invention, a stabilizer containing formaldehyde is common. Additionally, it is possible to use known stabilizers and processing methods described in U.S. Pat. Nos. 4,786,583 and 4,859,574, JP-A-3-33847, JP-A-4-270344, JP-A-4-313753, JP-A-4-359249, JP-A-5-34889, JP-A-5-165178, JP-A-57-8543, JP-A-58-14834, and JP-A-60-220345.

A compound (to be referred to as an image stabilizing agent hereinafter) for stabilizing a dye image is contained in the stabilizer of the present invention. Examples are formalin, benzaldehydes such as m-hydroxybenzaldehyde, a formaldehyde bisulfite adduct, hexamethylenetetramine and its derivative, hexahydrotriazine and its derivative, dimethylol urea, and an N-methylol compound such as N-methylolpyrazole. In the present invention, the free formaldehyde concentration in the solution is preferably 0 to 0.01%, and more preferably 0 to 0.005% because a great effect is obtained. Preferable image stabilizing agents by which this free formaldehyde concentration is attained are m-hydroxybenzaldehyde, hexamethylenetetramine, N-methylolazoles such as N-methylolpyrazole described in JP-A-4-270344, and azolylmethylamines such as N,N'-bis (1,2,4-triazole-1-ylmethyl) described in JP-A-4-313753.

The content of these image stabilizing agents is preferably 0.001 to 0.1 mol, and more preferably 0.001 to 0.05 mol per liter of the stabilizer.

It is preferable that the stabilizer of the present invention contain various surfactants to prevent a waterdrops variation during drying of the processed light-sensitive material. Examples of the surfactant are a polyethylglycol type nonionic surfactant, a polyvalent alcohol type nonionic surfactant, an alkylbenzenesulfonate type anionic surfactant, a higher alcohol sulfate type anionic surfactant, an alkylnaphthalenesulfonate type anionic surfactant, a quaternary ammonium salt type cationic surfactant, an amine salt type cationic surfactant, an amino salt type amphoteric surfactant, and a betaine type amphoteric surfactant. Use of the nonionic surfactants is preferable, and particularly nonionic surfactants of alkylphenoxypolyethyleneoxides and alkylphenoxypolyhydroxypropyleneoxides are preferable.

It is preferable that various chelating agents be contained in the stabilizer of the present invention in order to improve the stability of the stabilizer and reduce contamination.

To prevent mildew of bacteria, it is preferable to add antibacterial and antifungal agents to the stabilizer of the present invention. For this purpose commercially available antibacterial and antifungal agents can be used.

The pH of the stabilizer and the washing water of the present invention is 4 to 9, preferably 5 to 8. The processing temperature and the processing time also can be variously set in accordance with the characteristics and the intended use of the light-sensitive material. In general, the processing temperature and the processing time are 15° to 45° and 20 sec to 10 min, preferably 25° to 40° and 30 sec to 2 min, respectively. Furthermore, the contamination preventing effect of the stabilizer of the present invention significantly appears when processing is performed using the stabilizer immediately after the desilvering process without performing washing.

The quantity of replenisher of the stabilizer of the present invention is preferably 200 to 2000 ml per $m^2$ of the light-sensitive material. The overflow solutions resulting from replenishment of the washing water and/or the stabilizer can also be reused in other steps such as the desilvering step.

To reduce the use amount of the washing water, ion exchange or ultrafiltration can be used. Use of ultrafiltration is particularly preferable.

Various processing solutions of the present invention are used at 10° C. to 50° C. Although a temperature of 33° C.

to 38° C. is usually a standard temperature, the processing time can be shortened by encouraging the processing by raising the temperature. Conversely, it is possible to improve the image quality or the stability of the processing solution by lowering the temperature.

Generally, as various techniques and organic and inorganic materials usable in the silver halide photographic emulsions and the silver halide photographic light-sensitive materials using these emulsions used in the present invention, those described in Research Disclosure No. 308119 (1989) can be used.

In addition, the techniques and inorganic and organic materials usable in color photographic light-sensitive materials to which the silver halide photographic emulsions used in the present invention are applicable are described in more detail in the following portions of European Patent 436, 938A2 and in the patents cited below.

| | Item | Corresponding Portions |
|---|---|---|
| 1. | Layer arrangements: | page 146, line 34 to page 147, line 25 |
| 2. | Silver halide emulsions: | page 147, line 26 to page 148, line 12 |
| 3. | Yellow couplers: | page 137, line 35 to page 146, line 33, and page 149, lines 21 to 23 |
| 4. | Magenta couplers: | page 149, lines 24 to 28; EP 421,453A1, page 3, line 5 to page 25, line 55 |
| 5. | Cyan couplers: | page 149, lines 29 to 33; EP 432,804A2, page 3, line 28 to page 40, line 2 |
| 6. | Polymer couplers: | page 149, lines 34 to 38; EP 435,334A2, page 113, line 39 to page 123, line 37 |
| 7. | Colored couplers: | page 53, line 42 to page 137, line 34, and page 149, lines 39 to 45 |
| 8. | Other functional couplers: | page 7, line 1 to page 53, line 41, and page 149, line 46 to page 150, line 3; EP 435,334A2, page 3, line 1 to page 29, line 50 |
| 9. | Antiseptic and antifungal agents: | page 150, lines 25 to 28 |
| 10. | Formalin scavengers: | page 149, lines 15 to 17 |
| 11. | Other additives: | page 153, lines 38 to 47; EP 421,453A1, page 75, line 21 to page 84, line 56, and page 27, line 40 to page 37, line 40 |
| 12. | Dispersion methods: | page 150, lines 4 to 24 |
| 13. | Supports: | page 150, lines 32 to 34 |
| 14. | Firm thickness and film physical properties: | page 150, lines 35 to 49 |

The present invention will now be described in more detail with reference to the following examples, but the present invention is not to be construed as being limited thereto.

EXAMPLES

Example 1

(1) An example sample 102 described in JP-A-52-97543 was white-exposed through a gray wedge with an exposure of 20 CMS for an exposure time of 1/100 sec, and sensitometry was done by processing consisting of the following processing steps.

| Processing Step | Time | Temperature | Quantity of Replenisher ($m^2$) |
|---|---|---|---|
| First development | 6 min. | 38° C. | 2150 ml/$m^2$ |
| Washing | 2 min. | 38° C. | 21 l/min/$m^2$ |
| Reversal | 2 min. | 38° C. | 1100 ml/$m^2$ |
| Color development | 6 min. | 38° C. | 2150 ml/$m^2$ |
| Control | 2 min. | 38° C. | 1100 ml/$m^2$ |
| Bleaching | 6 min. | 38° C. | 215 ml/$m^2$ |
| Fixing | 4 min. | 38° C. | 1100 ml/$m^2$ |
| Washing | 4 min. | 38° C. | 21 l/min/$m^2$ |
| Stabilization | 1 min. | 25° C. | 1100 ml/$m^2$ |

The compositions of the individual processing solutions were as follows.

| <First developer> | Mother solution | Replenisher solution |
|---|---|---|
| Pentasodium nitrilo-N,N,N-trimethylene phosphonate | 1.5 g | 1.5 g |
| Pentasodium diethylenetriamine pentaacetate | 2.0 g | 2.0 g |
| Sodium sulfite | 30 g | 30 g |
| Hydroquinone.potassium monosulfonate | 20 g | 20 g |
| Potassium carbonate | 15 g | 19 g |
| Sodium bicarbonate | 12 g | 12 g |
| 1-phenyl-4-methyl-4-hydroxymethyl-3-pyrazolidone | 1.5 g | 1.5 g |
| Potassium bromide | 2.5 g | 1.4 g |
| Potassium thiocyanate | 1.2 g | 1.2 g |
| Potassium iodide | 2.0 mg | 1.6 mg |
| Diethyleneglycol | 13 g | 13 g |
| Water to make | 1000 ml | 1000 ml |
| pH | 9.60 | 9.72 |

The pH was controlled by hydrochloric acid or potassium hydroxide.

| <Reversal fogging solution> | Common to mother solution and replenisher solution |
|---|---|
| Pentasodium nitrilo-N,N,N-trimethylene phosphonate | 3.0 g |
| Stannous chloride.dihydrate | 1.0 g |
| p-aminophenol | 0.1 g |
| Sodium hydroxide | 8 g |
| Glacial acetic acid | 15 ml |
| Water to make | 1000 ml |
| pH | 6.00 |

The pH was controlled by hydrochloric acid or sodium hydroxide.

| <Color developer> | Mother solution | Replenisher solution |
|---|---|---|
| Pentasodium nitrilo-N,N,N-trimethylene phosphonate | 2.0 g | 2 g |
| Sodium sulfite | 7.0 g | 7 g |

-continued

| <Color developer> | Mother solution | Replenisher solution |
|---|---|---|
| Trisodium phosphate. dodecahydrate | 36 g | 36 g |
| Potassium bromide | 1.0 g | 0 g |
| Potassium iodide | 90 mg | 0 mg |
| Sodium hydroxide | 8 g | 12 g |
| Citrazinic acid | 1.5 g | 1.5 g |
| N-ethyl-N-(β-methanesulfon amidoethyl)-3-methyl-4-aminoaniline.3/2 sulfuric acid.monohydrate | 11 g | 11 g |
| 3,6-dithiaoctane-1,8-diol | 1.0 g | 1 g |
| Water to make | 1000 ml | 1000 ml |
| pH | 11.90 | 12.0 |

The pH was controlled by hydrochloric acid or potassium hydroxide.

| <Control solution> | Common to mother solution and replenisher solution |
|---|---|
| Disodium ethylenediaminetetraacetate dihydrate | 8.0 g |
| Sodium sulfite | 12 g |
| 1-thioglycerol | 0.4 g |
| Formaldehyde sodium bisulfite adduct | 30 g |
| Water to make | 1000 ml |
| pH | 6.20 |

The pH was controlled by hydrochloric acid or sodium hydroxide.

| <Bleaching solution> | Common to mother solution and replenisher solution |
|---|---|
| Disodium ethylenediaminetetraacetate dihydrate | 2.0 g |
| Ferric (III) ammonium ethylenediaminetetraacetate dihydrate | 120 g |
| Potassium bromide | 100 g |
| Ammonium nitrate | 10 g |
| Water to make | 1000 ml |
| pH | 5.70 |

The pH was controlled by hydrochloric acid or sodium hydroxide.

| <Fixing solution> | Common to mother solution and replenisher solution |
|---|---|
| Ammonium thiosulfate | 80 g |
| Sodium sulfite | 5.0 g |
| Sodium bisulfite | 5.0 g |
| Water to make | 1000 ml |
| pH | 6.60 |

The pH was controlled by hydrochloric acid or ammonia water.

| <Stabilizer> | Common to mother solution and replenisher solution |
|---|---|
| Benzoisothiazoline-3-one | 0.02 g |
| Polyoxyethylene-p-monononyl phenylether (average polymerization degree 10) | 0.3 g |
| Water to make | 1000 ml |
| pH | 7.0 |

In the photographic sensitometry thus obtained, a correct sensitometry curve with an average gradation of 1.8 was obtained (processing A). The sensitivity was ISO 95 to 106.

However, 2.15 l of the color developer were discharged pre $m^2$ of the light-sensitive material, and 3000 ppm of phosphorus was present in this waste solution. Therefore, this waste solution cannot be flowed into a sewerage in the closed sea even after being subjected to an activation sludge treatment.

On the other hand, when the same processing was performed by adding 19.8 g/l of a sulfosalicylic acid (compound (9)) instead of 36 g/l of trisodium phosphate.$12H_2O$, substantially equal photographic properties were attained, and the sensitivity also was ISO 95 to 106 (processing B). Accordingly, it is found that sulfosalicylic acid can be used when $13 \geqq pH \geqq 11$.

When 23.7 g/l of sulfosalicylic acid were added, the photographic properties substantially remained the same although $D_{max}$ decreased ($\Delta D=0.02$) (processing C).

Subsequently, changes in the photographic properties were examined by leaving the color reversal developers to stand in beakers at room temperature. The results are shown in Table 1 below. Generally, deterioration with time leads to a reduction in the competing coupler, and this encourages the color reversal development. Also, the higher the pH the more the effect of the fogging agent of the color reversal developer is enhanced, and when the pH is decreased the fogging effect is weakened and the color reversal development is discouraged. Accordingly, it is considered that deterioration with time effectively shows whether this combined effect is optimized.

TABLE 1

| | | RL shadow gradation* | | |
|---|---|---|---|---|
| | Aging | None | One week | Two weeks |
| Conventional example | Processing A | 0.72 | 0.57 | 0.43 |
| Present invention | Processing B | 0.72 | 0.66 | 0.62 |
| Present invention | Processing C | 0.72 | 0.68 | 0.67 |

Figure 3:
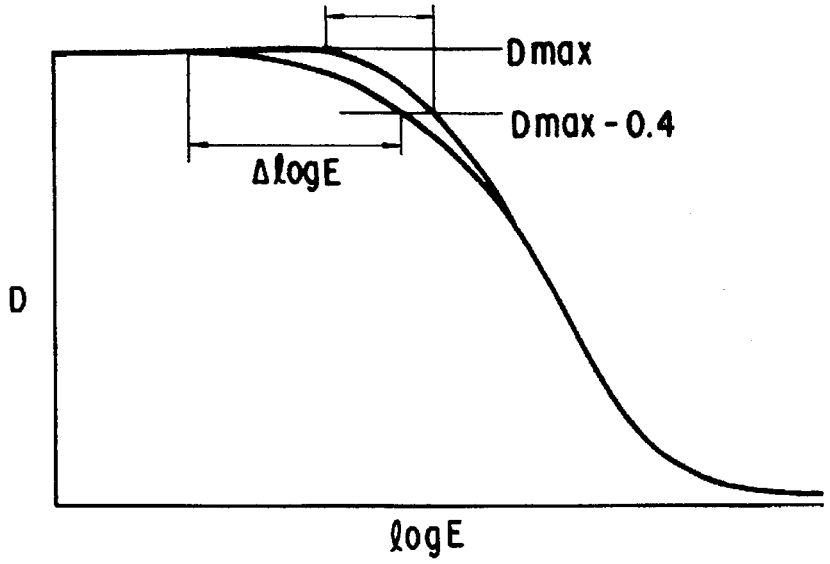
FIG. 3 is a graph showing the relationship between D and the value of logE.

*Shadow gradation indicates a ΔlogE value at which $D_{max} - 0.4$ and $D_{max}$ intersect the characteristic curve (see FIG. 3). FIG. 3 is a graph showing the relationship between D and the value of logE.
Average gradation is an average slope of the points at which $D_{max} - 0.4$ and $D_{min} + 0.1$ intersect the characteristic curve.

As is apparent from the results shown in Table 1, the changes in the photographic properties in the processing B and C are smaller than that in the processing A.

(2) The solutions aged for one and two weeks in the beakers in (1) described above were mixed at the ratios presented below with a new solution that was not aged and simultaneously subjected to the sensitometry process. The resultant RL shadow gradation was examined. The results are shown in Table 2 below.

TABLE 2

| New solution/aged solution | RL shadow gradation $GS_{RL}$ 1/1 | 2/1 | 4/1 |
|---|---|---|---|
| Processing A | | | |
| solution aged for one week | 0.65 | 0.67 | 0.70 |
| solution aged for two weeks | 0.55 | 0.61 | 0.66 |
| Processing B | | | |
| solution aged for one week | 0.68 | 0.70 | 0.71 |
| solution aged for two weeks | 0.66 | 0.69 | 0.70 |

As can be seen from the results in Table 2 above, the properties of the new solution were obtained in the processing B at a new solution addition ratio lower than that in the processing A.

That is, it is expected that the properties remain unchanged even if the quantity of replenisher in the processing B is reduced to ½ that in the processing A.

By using a processing machine H3R-60S manufactured by Noritsu Koki Co., Ltd., therefore, regular running (the solution exchange rate of the color reversal developer (CD) was 20%/day) of the processing A was performed. The result was that the RL shadow gradation change was within ΔGSRL=0.04. However, when running was done by decreasing the quantity of replenisher of CD to 1075 ml/m$^2$ in the processing A (CD exchange rate 10%/day), it was found that $\Delta GS_{RL}$=0.07.

Meanwhile, running was done by decreasing the quantity of replenisher of CD to 1075 ml/m$^2$ in the processing B (CD exchange rate 10%/day), with the result that $\Delta GS_{RL}$=0.03. That is, it was found that the shadow gradation change was small when sulfosalicylic acid was used without using phosphoric acid, although the reason is unknown.

Example 2

A sample further added with 3 g/l of hydroxylamine sulfate during the processing B in Example 1 (processing D) and a sample added with 3 g/l of an example compound (3) described in JP-A-62-242938 in place of hydroxylamine sulfate (processing E) were prepared and subjected to sensitometry after being left to stand in beakers at room temperature as in Example 1, thereby checking GSRL. The results are shown in Table 3 below.

TABLE 3

| | RL shadow gradation $GS_{RL}$ None | one week | two weeks |
|---|---|---|---|
| Processing A | 0.72 | 1.57 | 0.43 |
| Processing B | 0.72 | 0.66 | 0.62 |
| Processing D | 1.05 | 0.23 | 0.15 |
| Processing E | 0.97 | 1.26 | 0.37 |

As is evident from the results shown in Table 3, it was not at all possible to use color reversal developers added with hydroxylamine or a hydroxylamine derivative.

That is, it was found that these color reversal developers can be used with regular colors but are not easily applicable to color reversal development.

Example 3

Figure 2:
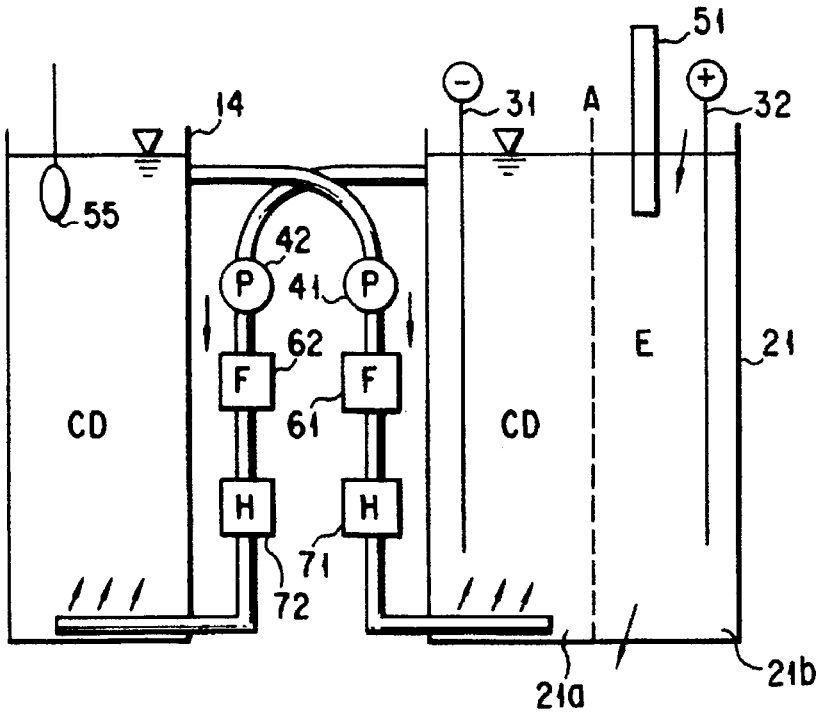
FIG. 2 is a schematic view showing an example of the arrangement of a color reversal development tank in FIG. 1, in which a halogen removing means is provided in the portion CD, compared to in FIG. 1.

By using a light-sensitive material (a sample 101 in Example 1 of JP-A-4-34548) described in Example 2 in JIII Journal of Technical Disclosure No. 94-19243 (issued Oct. 17, 1994), 81R06-10, a halogen removing mechanism (see FIG. 2) was formed in a color developer, and processing was performed following the same procedures as in Example 2 of 81R06-10. FIG. 2 is a schematic view showing the arrangement of a color reversal development tank in FIG. 1.

The reference symbols used in FIG. 1 will be explained below.

FD 11 . . . first black-and-white development tank, W1 12 . . . first washing tank, Rev 13 . . . reversal fogging tank, CD 14 . . . color reversal development tank, Con 15 . . . conditioner solution tank, BF 16 . . . bleach-fixing solution tank, W21 17 . . . first tank of second washing, W22 18 . . . second tank of second washing, SB 19 . . . stabilizer tank.

As the processor, a remodeled machine (see FIG. 1: without a halogen removing means 21 in FIG. 2) of FNCP-900 manufactured by Fuji Photo Film Co., Ltd. FIG. 1 is a schematic view showing the arrangement of tanks of the processing apparatus used in the method of the present invention. Processing was performed for two weeks with a processing amount of 3500 films/day (the dimensions of a film: 35 mm wide, 1 m long). This is processing 2A. In the processing 2A, good photographic properties were obtained when the quantity of replenisher of the color reversal developer was 2.2 l/m$^2$. That is, photographic management by control strips was stable within the range of the management.

In the processing 2A, the processing was performed by reducing the quantity of replenisher of the color developer to 600 ml/m$^2$ (processing 2B). Consequently, the minimum concentration began rising when 10 days passed from the start of the processing, resulting in tailing of highlight. It was therefore impossible to obtain good photographic properties.

Processing was performed in the same manner as in the processing 2B except that the color development tank was replaced with one having the arrangement shown in FIG. 2.

The reference symbols used in FIG. 2 will be explained below.

CD 14 . . . color reversal development tank, 55 . . . absorbent which absorbs the elution from the light-sensitive material except halogen, such as organic compound, for example, dye stuff, wetting agent and absorbs the carry-in material from reveal bath, P 41, 42 . . . circulating pump, F 61, 62 . . . filter, H 71, 72 . . . heater, 51 . . . bromine ion sensor, −31 . . . cathode, +32 . . . anode, 21 . . . halogen removing device (electrolytic dialysis tank), 21*b* . . . electrolytic chamber, A . . . anion exchange film, CD 21*a* . . . color reversal development tank.

A molybdenum-containing stainless steel (equivalent to SUS316) sheet (NTK316 available from Nippon Kinzoku Co., Ltd.: 63 cm×100 cm (thickness 1 mm)) was used as the cathode, and a carbon sheet (KURESHEET available from Kureha Chemical Industry Co. Ltd.: 63 cm×cm (thickness 1 mm)) was used as the anode. Also, Neosepta AM-3 (available from Tokuyama Soda Co. Ltd.) ($Br^-$ leak amount: 0.07 (KBr) g/Δl gKBr.one hour: 63 cm×100 cm) was used as the anion exchange film. Additionally, a 10% dilute solution of the overflow solution of the color reversal developer was used as the electrolyte.

Power supply was performed with a power supply amount of 0.32 A/sec each time the light-sensitive material passed (current density 0.3 A/dm$^2$; voltage 3.6 V). As the absorbent 55, we use the IRA-400 resin.

As a result, good photographic properties were attained. That is, photographic management by control strips was stable within the range of the management. Good photographic properties were also obtained even when the quantity of replenisher of the first black-and-white developer was set to 400 ml/m$^2$.

| Processing step | Time | Temperature | Tank volume | Quantity of replenisher |
|---|---|---|---|---|
| Black-and-white development | 6 min. | 38° C. | 12 l | 2.2 l/m$^2$ |
| 1st washing | 2 min. | 38° C. | 4 l | 7.5 l/m$^2$ |
| Reversal | 2 min. | 38° C. | 4 l | 1.1 l/m$^2$ |
| Color development | 6 min. | 38° C. | 12 l | 2.0 l/m$^2$ |
| Control | 2 min. | 38° C. | 4 l | 1.1 l/m$^2$ |
| Bleach-fixing | 6 min. | 38° C. | 12 l | 1.3 l/m$^2$ |
| 2nd washing (1)* | 2 min. | 38° C. | 4 l | — l/m$^2$ |
| 2nd washing (2) | 2 min. | 38° C. | 4 l | 7.5 l/m$^2$ |
| Stabilization | 2 min. | 38° C. | 4 l | 1.1 l/m$^2$ |

*The overflow solution of 2nd washing (2) was introduced to 2nd washing (1).

| <Black-and-white developer> | Mother solution | Replenisher solution |
|---|---|---|
| Pentasodium nitrilo-N,N,N-trimethylene phosphonate | 2.0 g | 2.5 g |
| Pentasodium diethylenetriamine pentaacetate | 3.0 g | 3.75 g |
| Sodium sulfite | 33.0 g | 50.0 g |
| Hydroquinone.potassium monosulfonate | 20.0 g | 45.0 g |
| Potassium carbonate | 33.0 g | 0 g |
| 1-phenyl-4-methyl-4-hydroxymethyl-3-pyrazolidone | 2.0 g | 2.6 g |
| Potassium bromide | 2.5 g | 0 g |
| Potassium thiocyanate | 1.2 g | 1.5 g |
| Potassium iodide | 2.0 mg | 0 mg |
| Water to make | 1.0 l | 1.0 l |
| pH (25° C.) | 9.60 | 9.60 |

<The pH was controlled by hydrochloric acid or potassium hydroxide.>

It is evident from the foregoing that phosphorus was removed by the replenishment of the color developer and the waste solution amount (including the overflow amount) also was reduced to ⅕. The buffer solution using sulfosalicylic acid can effectively decrease the quantity of replenisher in such a halogen removing system.

Example 4

A surface treatment such as glow discharge described in JP-B-46-43480 was performed for a 95-fm thick annealed PEN support described in JIII Journal of Technical Disclosure No. 94-6023. After undercoating described in U.S. Pat. No. 5,326,689 was performed, ferromagnetic particles described in JP-A-6-59357 were coated on the back side of the support. A sample 101 in Example 1 described in JP-A-4-34548 was coated on the surface of the resultant support, thereby forming a light-sensitive material.

In accordance with the method described in JP-A-4-125560, the light-sensitive material was cut into a film with a narrower width than that of conventional 135-size films. In order for the film to match a small-format frame smaller than conventional ones, two perforations were formed for each small-format frame on each side of the film.

The resultant film thus manufactured was placed in a cartridge described in U.S. Pat. No. 5,226,613 and loaded in a compact camera described in JP-A-5-150577, and photographing was performed.

The photographed film was processed by an automatic processor described in JP-A-6-222514 which was remodeled for color reversal. By using a film magnetic recording utilization method described in JP-A-6-95265 before, during, or after the processing, prints were formed by using an aspect ratio selecting function described in JP-A-5-19364. This processing was done by using a conventional phosphoric acid CD and the sulfosalicylic acid CD in Example 2. The magnetic reading error rates were compared, and the result was as shown in Table 4 below.

TABLE 4

| CD buffering agent | Error rate |
|---|---|
| Phosphoric acid | $2.7 \times 10^{-3}$ |
| Sulfosalicylic acid | $0.3 \times 10^{-3}$ |

Additionally, it was found that sulfosalicylic acid was effective because the quantity of replenisher could be reduced by half.

Furthermore, the processing in Example 3 was performed instead of phosphoric acid. Consequently, it was strange that the magnetic reading error rate was further improved. The result is shown in Table 5 below.

TABLE 5

| CD buffering agent | Replenishment rate | Error rate |
|---|---|---|
| Phosphoric acid | 2 l/m$^2$ | $2.9 \times 10^{-3}$ |
| Sulfosalicylic acid (Example 3) | 0.4 l/m$^2$ | $0.1 \times 10^{-3}$ |

Although this reason is unknown, it is considered that the use of the halogen removing mechanism decreased the magnetic reading error rate.

Example 5

Films having different light-sensitive material supports presented below were passed through the processor illustrated in FIG. 1, and the conveyance fraction defective was checked. The results are shown in Table 6 below. The conveyance fraction defective indicates the rate of bending or defective passage when 10,000 light-sensitive materials were processed. 0.1% was counted when one bending occurred, and 0.2% was counted when one defective passage occurred.

TABLE 6

| Thickness of support | Type of support | Conveyance properties (fraction defective) |
|---|---|---|
| 127 μm | Cellulose triacetate | 0.1% |
| 95 μm | Cellulose triacetate | 0.6% |
| 110 μm | Polyethylenenaphthalate | 1.2% |
| 105 μm | Polyethylenenaphthalate | 0.2% |
| 85 μm | Polyethylenenaphthalate | 0.1% |
| 80 μm | Polyethylenenaphthalate | 0.9% |
| 110 μm | Annealed polyethylenenaphthalate | 0.2% |

TABLE 6-continued

| Thickness of support | Type of support | Conveyance properties (fraction defective) |
|---|---|---|
| 105 μm | Annealed polyethylenenaphthalate | 0.01% |
| 85 μm | Annealed polyethylenenaphthalate | 0.01% |
| 80 μm | Annealed polyethylenenaphthalate | 0.1% |

The results shown in Table 6 revealed that, of the supports having a magnetic back, the support made from annealed polyethylenenaphthalate and having a thickness of 85 to 105 μm had the best conveyance properties.

Example 6

The formulation of the first developer in Example 1 was changed as follows, and processing was performed with a quantity of replenisher of a color developer of 2150 ml/m$^2$ by using an automatic processor H3R-60S manufactured by Noritsu Koki Co., Ltd.

| | Mother solution | Replenisher solution |
|---|---|---|
| Pentasodium nitrilo-N,N,N-trimethylene phosphonate | 1.5 g | 1.5 g |
| Pentasodium diethylenetriamine pentaacetate | 2.0 g | 2.0 g |
| Sodium sulfite | 30 g | 30 g |
| Ascorbic acid | 15 g | 15 g |
| Potassium carbonate | 15 g | 17 g |
| Sodium bicarbonate | 12 g | 12 g |
| 1-phenyl-4-methyl-4-hydroxymethyl-3-pyrazolidone | 1.5 g | 1.5 g |
| Potassium bromide | 2.5 g | 1.4 g |
| Potassium thiocyanate | 1.2 g | 1.2 g |
| Potassium iodide | 2.0 mg | 1.6 mg |
| Diethyleneglycol | 13 g | 13 g |
| Water to make | 1 l | 1 l |
| pH | 9.5 | 10.10 |

The pH was controlled by hydrochloric acid or potassium hydroxide.

The RL shadow gradation change was 0.03 in either case, i.e., a similar stable result was obtained even when the developing agent of the first developer was changed to ascorbic acid. Note that the pH of the first developer after running was 9.55.

What is claimed is:

1. A method for processing a silver halide color reversal photographic light-sensitive material, in which a silver halide color reversal photographic light-sensitive material having at least one negative silver halide emulsion layer on a support is imagewise-exposed and subjected to first black-and-white development, fogging process, color reversal development, and desilvering process, thereby forming a color reversal image, wherein the color reversal development is performed by using a color reversal developer with a composition containing (a) a non-dye-forming competing coupler, (b) a silver halide fogging agent, and (c) a compound represented by Formula (1) below, and not containing (d) hydroxylamine or a derivative thereof:

Formula (1)

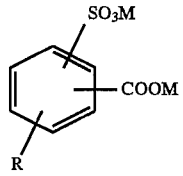

wherein R represents —OH, —$NO_2$, X, H, —COOH, —$SO_3M$, a lower alkyl group having 1 to 4 carbon atoms, or a hydroxy group- or carboxyl group-substituted lower alkyl group having 1 to 4 carbon atoms, M represents Li, Na, or K, and X represents halogen.

2. The method according to claim 1, wherein hydrazinic acid and 3,6-dithiaoctane-1,8-diol are used as the non-dye-forming competing coupler and the silver halide fogging agent, respectively.

3. The method according to claim 1, wherein the processing is continuously performed while the color reversal developer is replenished at a quantity of replenisher of not more than 1100 ml/m$^2$.

4. The method according to claim 3, wherein the processing is performed while halogen is removed from the color reversal developer and the color reversal developer is replenished at a quantity of replenisher of 40 to 500 ml/m$^2$.

5. The method according to claim 1, wherein the support of said light-sensitive material is made from annealed polyethylenenaphthalate and 85 to 105 μm in thickness, and has a magnetic recording layer made from a ferromagnetic fine powder on a side away from the emulsion layer.

6. The method according to claim 3, wherein the processing is continuously performed while the color reversal developer is replenished at a quantity of replenisher in a range of 40 ml/m$^2$ to 1100 ml/$^2$.

* * * * *